US009525933B2

(12) United States Patent
Chen et al.

(10) Patent No.: US 9,525,933 B2
(45) Date of Patent: Dec. 20, 2016

(54) ULTRATHIN SPEAKER MODULE

(71) Applicant: GOERTEK INC., Weifang, ShanDong Province (CN)

(72) Inventors: Gang Chen, Weifang (CN); Shuangshuang Fan, Weifang (CN); Dan Han, Weifang (CN); Yun Yang, Weifang (CN)

(73) Assignee: GOERTEK INC. (CN)

( * ) Notice: Subject to any disclaimer, the term of this patent is extended or adjusted under 35 U.S.C. 154(b) by 0 days.

(21) Appl. No.: 14/761,920

(22) PCT Filed: Dec. 17, 2013

(86) PCT No.: PCT/CN2013/089699

§ 371 (c)(1),
(2) Date: Jul. 17, 2015

(87) PCT Pub. No.: WO2014/110953

PCT Pub. Date: Jul. 24, 2014

(65) Prior Publication Data

US 2015/0358705 A1 Dec. 10, 2015

(30) Foreign Application Priority Data

Jan. 18, 2013 (CN) ..... 2013 1 0026575

(51) Int. Cl.

| | |
|---|---|
| ***H04R 1/28*** | (2006.01) |
| ***H04R 1/02*** | (2006.01) |
| *H04R 9/02* | (2006.01) |

(52) U.S. Cl.

CPC ..... *H04R 1/2842* (2013.01); *H04R 1/02* (2013.01); *H04R 9/025* (2013.01); *H04R 2499/11* (2013.01)

(58) Field of Classification Search

CPC ..... H04R 1/02; H04R 1/021; H04R 1/025; H04R 1/22; H04R 1/28; H04R 1/2803; H04R 1/2807; H04R 1/2811; H04R 1/2853; H04R 1/2857; H04R 1/2869; H04R 1/2873; H04R 1/2884–1/2896; H04R 9/00; H04R 9/02; H04R 9/025; H04R 2201/02; H04R 2201/029; H04R 2400/11; H04R 2499/11; H04R 1/2842

See application file for complete search history.

(56) References Cited

U.S. PATENT DOCUMENTS 6,002,949 A * 12/1999 Hawker ..... H04M 1/0202 361/814
6,526,150 B2 * 2/2003 Kelly ..... H04M 1/20 379/430

(Continued)

FOREIGN PATENT DOCUMENTS

CN 201219304 Y 4/2009
CN 102711004 A 10/2012

(Continued)

OTHER PUBLICATIONS

International Search Report for corresponding International Application No. PCT /CN2013/089699, mailed Mar. 20, 2014.

*Primary Examiner* — Phung-Hoang J Nguyen
*Assistant Examiner* — Joshua Kaufman
(74) *Attorney, Agent, or Firm* — Hauptman Ham, LLP

(57) ABSTRACT

An ultrathin speaker module, comprising: a casing provided with a sound hole thereon; a speaker unit comprising a diaphragm; a first separating wall provided with a diaphragm accommodating hole, wherein the diaphragm is fixed in the diaphragm accommodating hole, and the first separating wall and the diaphragm separate the internal space of the casing into an upper space and a lower space; and a second separating wall, which separates the upper space into one first upper cavity and at least one second (Continued)

upper cavity, wherein the first upper cavity comprises the diaphragm and forms a front acoustic cavity, and the front acoustic cavity is in communication with the outside through the sound hole on the casing; and the at least one second upper cavity is in communication with the lower space through a through hole on the first separating wall, and forms a rear acoustic cavity.

10 Claims, 3 Drawing Sheets

(56) References Cited

U.S. PATENT DOCUMENTS 6,834,181 B2 * 12/2004 Kaikuranta ..... H01Q 1/243 455/569.1
6,907,955 B2 * 6/2005 Masuda ..... G10K 9/13 181/148
7,505,602 B2 * 3/2009 Eaton ..... H04M 1/035 379/433.02
7,556,121 B2 * 7/2009 Yang ..... H04M 1/03 181/145
7,894,620 B2 * 2/2011 Yang ..... H04R 1/021 379/433.02
8,098,867 B2 * 1/2012 Hampton ..... H04R 1/2803 381/333
8,213,659 B2 * 7/2012 Mottonen ..... H04M 1/0245 381/345
8,259,985 B2 * 9/2012 Yang ..... H04R 1/021 381/386
9,154,865 B2 * 10/2015 Zha ..... H04R 1/021
2003/0123692 A1 * 7/2003 Ueki ..... H04R 1/44 381/398
2004/0170291 A1 * 9/2004 Eaton ..... H04M 1/035 381/334
2006/0120549 A1 * 6/2006 Burghardt ..... G10K 11/04 381/351
2009/0169041 A1 * 7/2009 Zurek ..... H04M 1/035 381/345
2010/0329496 A1 * 12/2010 Mottonen ..... H04M 1/035 381/349
2011/0019855 A1 * 1/2011 Lee ..... H04R 1/2819 381/349
2013/0094685 A1 * 4/2013 Seo ..... H04R 1/021 381/332
2013/0128130 A1 * 5/2013 Yamauchi ..... H04N 5/642 348/836
2013/0322672 A1 12/2013 Wang
2014/0029779 A1 * 1/2014 Yamauchi ..... H04N 5/642 381/333
2014/0177902 A1 * 6/2014 Yeh ..... H04R 1/227 381/394
2015/0063595 A1 * 3/2015 Kemppinen ..... H04M 1/6041 381/101
2015/0256922 A1 * 9/2015 Shi ..... H04R 1/2842 381/353
2015/0358705 A1 * 12/2015 Chen ..... H04R 1/2842 381/386
2016/0119718 A1 * 4/2016 Yang ..... H04R 9/02 381/351

FOREIGN PATENT DOCUMENTS

CN 202551150 U 11/2012
CN 202679442 U 1/2013
CN 103118320 A 5/2013
CN 203086730 U 7/2013

* cited by examiner

ULTRATHIN SPEAKER MODULE

CROSS-REFERENCE TO RELATED APPLICATION

The present application claims the priority from Chinese Patent Application No. 201310026575.6 filed on Jan. 18, 2013, the content of which is incorporated herein by reference in its entirety.

TECHNICAL FIELD

The present invention relates to the field of a speaker, and in particular to an ultrathin speaker module.

BACKGROUND ART

Along with the thinning of portable electronic devices, a speaker module as an important acoustic device also becomes increasingly thinner. Usually, the speaker module comprises a front acoustic cavity and a rear acoustic cavity, where the front acoustic cavity refers to an acoustic cavity formed of the space above the diaphragm in the speaker module, while the rear acoustic cavity refers to an acoustic cavity formed of the space below the diaphragm in the speaker module. Usually, the volume of the front acoustic cavity is not necessary to be large, however, in order to enhance the acoustic characteristics in the low frequency of the speaker module, the volume of the rear acoustic cavity is required to be relatively large. Along with the thinning of the speaker module, the space left to the rear acoustic cavity becomes smaller and smaller, and thus it is difficult to guarantee the acoustic performance of the speaker module while implementing the thinning of the speaker module. Therefore, it is necessary to improve the structure of the speaker module, so as to reduce the impact of the thinning of the speaker module on its acoustic characteristics (particularly those in the low frequency).

SUMMARY OF THE INVENTION

The present invention is made to solve the problem existing in the above mentioned prior art, and its object is to provide an ultrathin speaker module, wherein the volume of a rear acoustic cavity is increased by fully utilizing the internal space of the speaker module, thereby reducing the impact of the thinning of the speaker module on its acoustic characteristics (particularly those in the low frequency).

In order to achieve the above mentioned object, the present invention provides an ultrathin speaker module, comprising: a casing, which is provided with a sound hole thereon; a speaker unit, which comprises a diaphragm; a first separating wall, which is provided with a diaphragm accommodating hole, wherein the diaphragm of the speaker unit is fixed in the diaphragm accommodating hole, and the first separating wall and the diaphragm separate the internal space of the casing into an upper space and a lower space; and a second separating wall, which separates the upper space into one first upper cavity and at least one second upper cavity, wherein the first upper cavity comprises the diaphragm and forms a front acoustic cavity, and the front acoustic cavity is in communication with the outside through the sound hole on the casing, and the at least one second upper cavity is in communication with the lower space through a through hole on the first separating wall and forms a rear acoustic cavity.

Preferably, the casing may comprise an upper casing part, a middle casing part and a lower casing part, wherein the first separating wall is located in the middle casing part.

Preferably, the body of the casing may be made of plastic, and the part of the casing directly facing the diaphragm may be made of a metal insert.

Preferably, the sound hole may be arranged on a lateral side of the casing. Preferably, the first separating wall may be a horizontal separating wall, while the second separating wall may be a vertical separating wall.

Preferably, the speaker unit may further comprise a voice coil and a magnetic circuit system located in the lower space, where the voice coil is combined with the diaphragm, the magnetic circuit system is fixed on the first separating wall and/or the casing, and the voice coil is accommodated in a magnetic gap of the magnetic circuit system.

Preferably further, the magnetic circuit system may be provided with a through hole which allows a space between the diaphragm and the magnetic circuit system to be in communication with other parts of the lower space.

Preferably further, the casing may be further provided with an accommodating groove or accommodating hole thereon, in which the magnetic circuit system is accommodated.

In the ultrathin speaker module described by the present invention, since a part of the space above the diaphragm is in communication with the space below the diaphragm to form the rear acoustic cavity together, the volume of the rear acoustic cavity can be increased with the thickness of the speaker module unchanged, or the volume of the rear acoustic cavity can remain unchanged with the thickness of the speaker module decreased, thereby reducing the impact of the thinning of the speaker module on its acoustic characterisitics (particularly those in the low frequency). In addition, by replacing the part of the casing directly facing the diaphragm with a metal insert, and accommodating the magnetic circuit system into the accommodating groove or accommodating hole on the casing, the thickness of the speaker module can be reduced further or the volumes of the acoustic cavities in the speaker module can be increased.

BRIEF DESCRIPTION OF THE DRAWINGS

The above features and technical advantages of the present invention will become more clear and more readily understandable through the following description in conjunction with the drawings.

DETAILED DESCRIPTION OF EMBODIMENTS OF THE INVENTION

The present invention will be described in detail below in conjunction with the drawings and specific embodiments.

In the following description, certain exemplary embodiments of the present invention are described only by way of illustration. Needless to say, one of ordinary skill in the art can realize that, variations can be made to the embodiments in various ways without departing from the spirit and scope of the present invention. Accordingly, the drawings and description are illustrative in nature, and are not intended to limit the protection scope of the claims. In the present specification, same reference signs denote same or similar parts.

Figure 1:
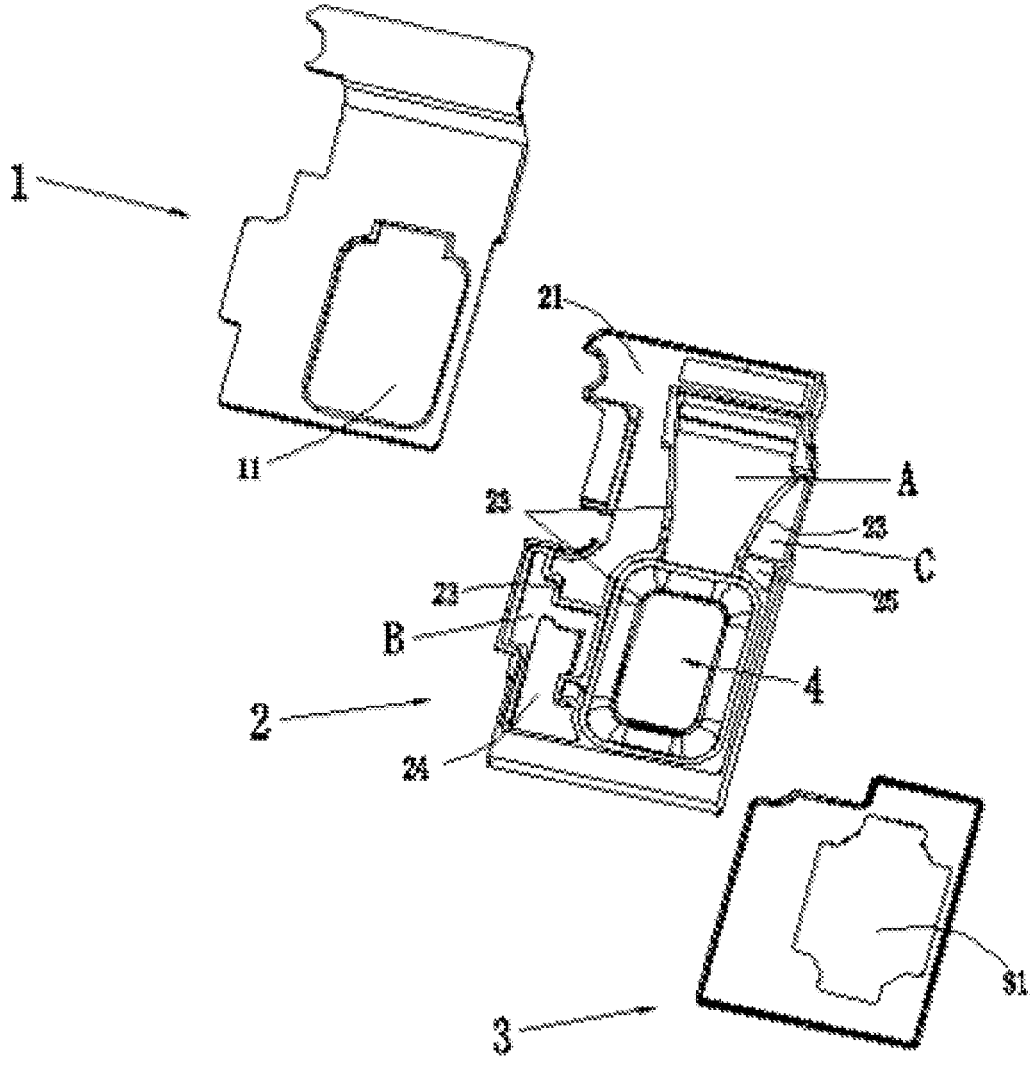
FIG. 1 is an exploded perspective view showing the exploded structure of an ultrathin speaker module according to an embodiment of the present invention.
Figure 2:
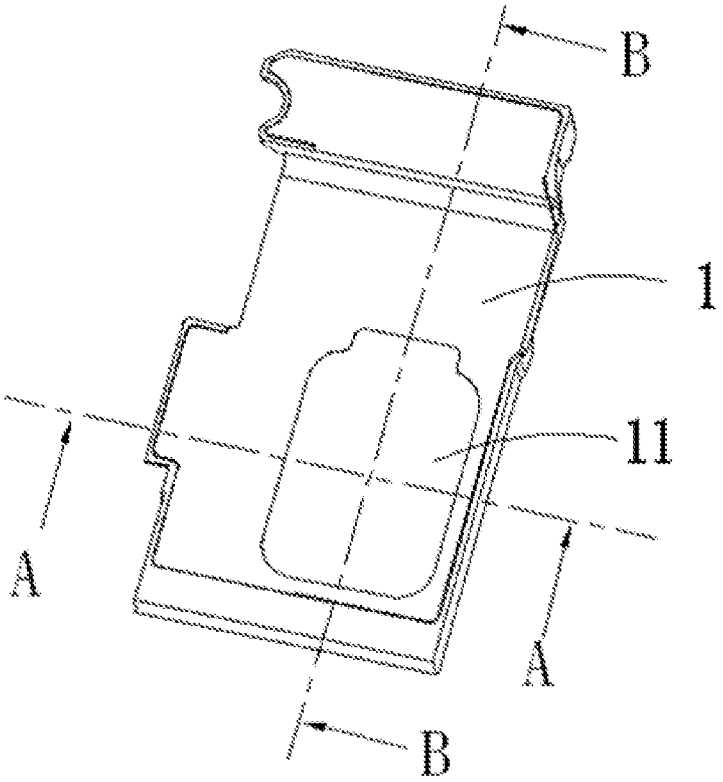
FIG. 2 is a perspective view showing the assembly structure of the ultrathin speaker module in FIG. 1.
Figure 3:
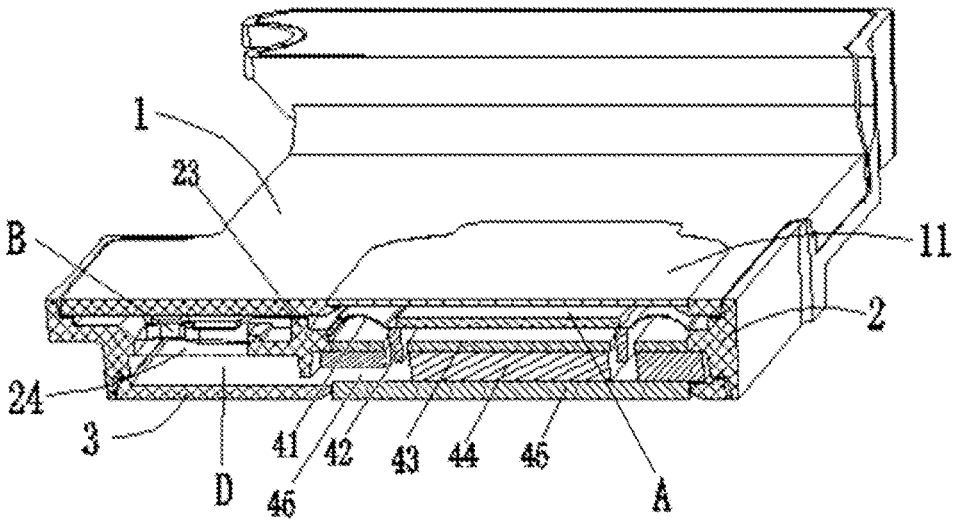
FIG. 3 is a sectional view of the ultrathin speaker module shown in FIG. 2 cut along A-A line; and, FIG. 4 is a sectional view of the ultrathin speaker module shown in FIG. 2 cut along B-B line.
Figure 4:
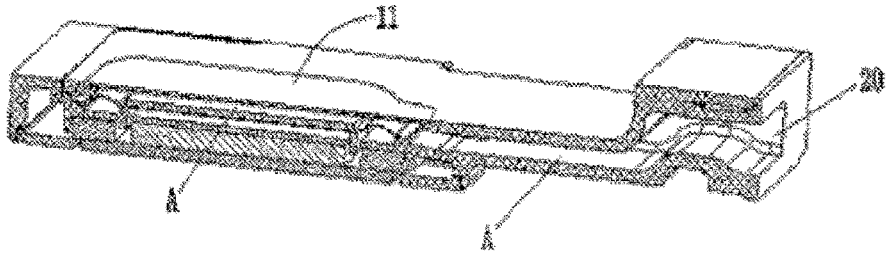

FIG. 1 is an exploded perspective view showing the exploded structure of an ultrathin speaker module according to an embodiment of the present invention; FIG. 2 is a perspective view showing the assembly structure of the ultrathin speaker module in FIG. 1; FIG. 3 is a sectional view of the ultrathin speaker module shown in FIG. 2 cut along A-A line; and, FIG. 4 is a sectional view of the ultrathin speaker module shown in FIG. 2 cut along B-B line.

As shown in FIGS. 1-4, the ultrathin speaker module according to an embodiment of the present invention comprises a casing, a speaker unit 4, a first separating wall 21, and a second separating wall 23.

Specifically, the casing is provided with a sound hole 20 thereon. Additionally, for the convenience of assembly, the casing may comprise an upper casing part 1, a middle casing part 2 and a lower casing part 3, but is not limited thereto.

The speaker unit 4 comprises a diaphragm 41, and may further comprise a voice coil 42 and a magnetic circuit system, where the voice coil 42 is combined with the diaphragm so as to form a vibration system of the speaker unit 4; the magnetic circuit system may include a washer 43, a magnet 44 and a concentrating flux plate 45 combined with each other in sequence, for example, and the magnetic circuit system can be a double magnetic circuit structure, i.e., it comprises a centrally located inner magnetic circuit and an peripherally located outer magnetic circuit, between which there is formed a magnetic gap, in which magnetic gap the voice coil 42 can be accommodated. When an electrical signal is applied to the voice coil 42, the magnetic field generated by the voice coil interacts with the magnetic field of the magnetic circuit system, thus generating the vibration of the voice coil 42, which further leads to the vibration of the diaphragm 41, thus producing sound.

The first separating wall 21 is provided with a diaphragm accommodating hole, the diaphragm 41 of the speaker unit 4 is fixed in the diaphragm accommodating hole, and the first separating wall 21 and the diaphragm 41 separate the internal space of the casing into an upper space and a lower space. In the present embodiment, the first separating wall 21 may be located in the middle casing part 2 of the casing, and the upper space is formed by the space between the middle casing part 2 and the upper casing part 1, while the lower space is formed by the space between the middle casing part 2 and the lower casing part 3. The voice coil 42 and the magnetic circuit system in the speaker 4 having the above mentioned structure are located in the lower space, while the magnetic circuit system can be fixed on the first separating wall 21 and/or the casing. In case that there is no other communication means between the space between the diaphragm 41 and the magnetic circuit system, and the other parts of the lower space, a through hole may be provided on the magnetic circuit system. For example, a through hole 46 is provided on the outer magnetic circuit of the magnetic circuit system, so that the space between the diaphragm 41 and the magnetic circuit system is in communication with the other parts of the lower space (such as the hollow cavity D in FIG. 3). It should be noted that the space between the diaphragm 41 and the magnetic circuit system constitutes a part of the lower space.

The second separating wall 23 separates the upper space into a first upper cavity A and at least one second upper cavity, such as a second upper cavity B and a second upper cavity C. The second separating wall 23 may be arranged on the middle casing part 2, may also be arranged on the upper casing part 1, or may be arranged partly on the middle casing part 2 and partly on the upper casing part 1, etc.

The first upper cavity A comprises the diaphragm 41 and forms a front acoustic cavity, which is in communication with the outside through the sound hole 20 on the casing. In the present embodiment, the sound hole 20 may be arranged on a lateral side of the casing (as shown in FIG. 4). Thus, when the speaker module of the present invention is installed in an electronic device, the sound hole 20 will not be blocked when the electronic device is posed flatwise. However, the present invention is not limited thereto.

The at least one second upper cavity is in communication with the lower space through a through hole on the first separating wall 21, and forms a rear acoustic cavity. For example, in the present embodiment, the second upper cavity B may be in communication with the lower space through a through hole 24 on the first separating wall 21, while the second upper cavity C may be in communication with the lower space through a through hole 25 on the first separating wall 21.

Since the rear acoustic cavity fully utilizes the space adjacent to the front acoustic cavity above the diaphragm 41, the volume of the rear acoustic cavity is increased. In case that the size of the speaker module in the direction of thickness is limited and thus it is unable to provide an enough volume for the rear acoustic cavity in the space below the diaphragm 41, this structure of increasing the volume of the rear acoustic cavity can maintain or improve the low frequency acoustic characteristics of the speaker module. Furthermore, since the second upper cavities B and C and the first upper cavity A are acoustic cavities separate from each other, the second upper cavities B and C will not interfere with the sound effect of the speaker module. Furthermore, the shapes and sizes of the through hole 24 and the through hole 25 may be determined according to the air flow patency between the second upper cavity and the space below the diaphragm 41.

It should be noted that, the first separating wall may be a horizontal separating wall, while the second separating wall may be a vertical separating wall, but the present invention is not limited thereto. In other embodiments, in order to fully utilize space or improve the shapes of the acoustic cavities, based on a specific design, the first separating wall may form a curved shape in a 3D space, while the second separating wall may also form a non-right angle with the first separating wall.

In order to increase the volume of the front acoustic cavity A or further reduce the thickness of the speaker module, as shown in FIGS. 1-4, when the body of the casing is made of plastic, the part of the casing directly facing the diaphragm 41 can be made of a metal insert 11. Under the condition of a certain strength, compared to the plastic structure, the metal insert 11 can have a smaller thickness. Therefore, in case that the thickness of the speaker module is constant, the arrangement of the metal insert 11 can provide more space to the front acoustic cavity of the diaphragm 41, or in case that the volume of the front acoustic cavity is constant, the thickness of the speaker module can be decreased further. The metal insert 11 can be combined with the other parts of the casing by way of injection molding or hot melting of a heat stake.

In addition, in order to further reduce the thickness of the speaker module, as shown in FIGS. 1-4, an accommodating groove or accommodating hole 31 may be provided on the casing, and the magnetic circuit system (such as the concentrating flux plate 45 of the magnetic circuit system) may be accommodated in the accommodating groove or accommodating hole 31. In the present embodiment, since a through hole 46 is provided in the outer magnetic circuit of the magnetic circuit system, the space between the diaphragm 41 and the magnetic circuit system can be in communication with the other parts (such as the hollow cavity D in FIG. 3) of the lower space, and in turn can be in communication with the second upper cavities B and C, these spaces forming the rear acoustic cavity together.

It can be known from the foregoing description and practice that, in the ultrathin speaker module described in the present invention, since a part of the space above the diaphragm is in communication with the space below the diaphragm to form the rear acoustic cavity together, in case that the thickness of the speaker module is constant, the volume of the rear acoustic cavity can be increased, or in case that the thickness of the speaker module decreases, the volume of the rear acoustic cavity remains unchanged, thereby reducing the impact of the thinning of the speaker module on its acoustic characteristics (particularly those in the low frequency). In addition, by replacing the part of the casing directly facing the diaphragm with a metal insert, and accommodating the magnetic circuit system into the accommodating groove or accommodating hole on the casing, the thickness of the speaker module can be reduced further or the volumes of the acoustic cavities in the speaker module can be increased.

It should be noted that one skilled in the art may make various modifications, variations and combinations on the basis of the above mentioned embodiments, and these modifications, variations and combinations are within the protection scope of the present invention. It should be understood that the above detailed description is only intended to illustrate the present invention, and the scope of the present invention is defined by the appended claims and their equivalents.

What is claimed is:

1. An ultrathin speaker module, comprising:

a casing, which is provided with a sound hole thereon;

a speaker unit, which comprises a diaphragm;

a first separating wall, which is provided with a diaphragm accommodating hole, wherein the diaphragm of the speaker unit is fixed in the diaphragm accommodating hole, and the first separating wall and the diaphragm separate the internal space of the casing into an upper space and a lower space;

a second separating wall, which separates the upper space into one first upper cavity and at least one second upper cavity, wherein the first upper cavity comprises the diaphragm and forms a front acoustic cavity, and the front acoustic cavity is in communication with outside through the sound hole on the casing; and the at least one second upper cavity is in communication with the lower space through a through hole on the first separating wall, and forms a rear acoustic cavity;

wherein the speaker unit further comprises a voice coil and a magnetic circuit system located in the lower space, the voice coil is combined with the diaphragm, the magnetic circuit system is fixed on the first separating wall and/or the casing, and the voice coil is accommodated in a magnetic gap of the magnetic circuit system; and wherein the magnetic circuit system is provided with a through hole which allows a space between the diaphragm and the magnetic circuit system to be in communication with other parts of the lower space.

2. The ultrathin speaker module according to claim 1, wherein the casing comprises an upper casing part, a middle casing part and a lower casing part, wherein the first separating wall is located in the middle casing part.

3. The ultrathin speaker module according to claim 1, wherein the body of the casing is made of plastic, and the part of the casing facing directly the diaphragm is made of a metal insert.

4. The ultrathin speaker module according to claim 1, wherein the sound hole is arranged on a lateral side of the casing.

5. The ultrathin speaker module according to claim 1, wherein the first separating wall is a horizontal separating wall, while the second separating wall is a vertical separating wall.

6. An ultrathin speaker module, comprising:

a casing, which is provided with a sound hole thereon;

a speaker unit, which comprises a diaphragm;

a first separating wall, which is provided with a diaphragm accommodating hole, wherein the diaphragm of the speaker unit is fixed in the diaphragm accommodating hole, and the first separating wall and the diaphragm separate the internal space of the casing into an upper space and a lower space;

a second separating wall, which separates the upper space into one first upper cavity and at least one second upper cavity, wherein the first upper cavity comprises the diaphragm and forms a front acoustic cavity, and the front acoustic cavity is in communication with outside through the sound hole on the casing; and the at least one second upper cavity is in communication with the lower space through a through hole on the first separating wall, and forms a rear acoustic cavity;

wherein the speaker unit further comprises a voice coil and a magnetic circuit system located in the lower space, the voice coil is combined with the diaphragm, the magnetic circuit system is fixed on the first separating wall and/or the casing, and the voice coil is accommodated in a magnetic gap of the magnetic circuit system; and wherein the casing is further provided with an accommodating groove or accommodating hole thereon, in which the magnetic circuit system is accommodated.

7. The ultrathin speaker module according to claim 6, wherein the casing comprises an upper casing part, a middle casing part and a lower casing part, wherein the first separating wall is located in the middle casing part.

8. The ultrathin speaker module according to claim 6, wherein the body of the casing is made of plastic, and the part of the casing facing directly the diaphragm is made of a metal insert.

9. The ultrathin speaker module according to claim 6, wherein the sound hole is arranged on a lateral side of the casing.

10. The ultrathin speaker module according to claim 6, wherein the first separating wall is a horizontal separating wall, while the second separating wall is a vertical separating wall.

* * * * *